US005334050A

United States Patent [19]

Andrews

[11] Patent Number: 5,334,050

[45] Date of Patent: Aug. 2, 1994

[54] COAXIAL CONNECTOR MODULE FOR MOUNTING ON A PRINTED CIRCUIT BOARD

[76] Inventor: Derek Andrews, Platanenstraat 23, Vinkel, Netherlands, 5382 KA

[21] Appl. No.: 17,113

[22] Filed: Feb. 12, 1993

[30] Foreign Application Priority Data

Feb. 14, 1992 [NL] Netherlands ..... 9200272

[51] Int. Cl.[5] ..... H01R 17/04

[52] U.S. Cl. ..... 439/579; 439/581; 439/63

[58] Field of Search ..... 439/578–585, 439/63, 675

[56] References Cited

U.S. PATENT DOCUMENTS

| | | | |
|---|---|---|---|
| 4,598,961 | 7/1986 | Cohen | 439/581 |
| 4,741,703 | 5/1988 | Johnescu et al. | 439/581 |
| 4,946,392 | 8/1990 | Kobler et al. | 439/581 |
| 5,011,415 | 4/1991 | Suzuki et al. | 439/63 |
| 5,112,249 | 3/1992 | Henry et al. | 439/581 |
| 5,169,343 | 12/1992 | Andrews | 439/581 |

FOREIGN PATENT DOCUMENTS

| | | |
|---|---|---|
| 0354678 | 7/1989 | European Pat. Off. . |
| 0414495 | 8/1990 | European Pat. Off. . |
| 2552939 | 2/1984 | France . |
| 2248730 | 8/1991 | United Kingdom . |

*Primary Examiner*—David L. Pirlot
*Attorney, Agent, or Firm*—Woodcock, Washburn, Kurtz, Mackiewicz & Norris

[57] ABSTRACT

A coaxial connector module (1), comprising a housing (2) provided with electrically conducting contact elements (4) at least two of which are disposed above one another. Each contact element (4) having a contact side in the form of a coaxial inner and outer contact part (6,5) and a connection side in the form of an electrical conductor (25) connected to the inner contact part (6), and a shielding casing (14,15) of electrically conducting a sheet material surrounding the conductor (25) in an electrically insulating manner. The casing (14,15) having an essentially circular cylindrical shape (18) which merges into two adjacent side-pieces (22,19) provided with connection ends (23) for right angle mounting on a printed circuit board (9), in particular for surface mounting. The side-pieces (19) of a casing (15) of a higher situated contact element (4) bounds partly a circular cylindrical cross-section (20) which engages on the circular cylindrical part (18) of the casing (14) situated lower down.

12 Claims, 2 Drawing Sheets

COAXIAL CONNECTOR MODULE FOR MOUNTING ON A PRINTED CIRCUIT BOARD

BACKGROUND OF THE INVENTION

The invention relates to a coaxial connector module, comprising a housing of electrically insulating material provided with at least two electrical contact elements each having a contact side in the form of a coaxial inner and outer contact part for contacting a further connector and a right angle connection side for mounting on a printed circuit board in the form of an electrical conductor which is connected to the inner contact part and is provided with a connection end for mounting on the printed circuit board, said conductor is surrounded in an electrically insulating manner by a shielding of electrically conducting sheet material which is electrically connected to the outer contact part, said casing having an essentially circular cylindrical shape which towards the connection end of the conductor merges into two adjacent side-pieces provided with at least one connection end for mounting on the printed circuit board.

A coaxial connector module of this type having a row of single contact elements is disclosed by, inter alia, European Patent Application 0,354,678.

European Patent Application 91203142.4, which is not a prior publication discloses a coaxial connector module having a plurality of contact elements arranged in rows and columns. The contact elements of this module are provided with a rectangular shielding casing of sheet metal. These casings can be easily adjacently arranged.

However, it has been found that such a sheet metal rectangular shielding casing introduces an impedance mismatch to the coaxial inner and outer contact part at the contact side of a contact element. Impedance mismatch can lead to undesirable reflections and a lower signal power transfer between the contact side and the connection side of the contact element.

SUMMARY OF THE INVENTION

The object of the invention on is therefore to provide a coaxial connector module of the type mentioned in the preamble, having at least 10 two contact elements which are disposed above one another viewed from the connection side and are provided with shielding cases having a negligible impedance mismatch between the contact and connection side of the contact elements.

This is achieved according to the invention in that a first part of the side-pieces of the casing of a higher situated contact element bounds a circular cylindrical cross-section and engages on the circular cylindrical part of the adjacent casing situated lower down, while a second part of said side-pieces extends beyond the lower situated casings and having at least one connection end.

In the connection module according to the invention, the circular cylindrical shielding in a column of adjacently arranged contact elements is maintained as far as possible, while the cylindrical part of a casing situated lower down acts as a shield for the cylindrical casing higher up, which engages on the casing lower down. By suitably dimensioning the casings with respect to the electrical conductor connected to the inner contact part, the electrical impedance at the connection side can substantially be equal over the greatest possible frequency range to the impedance at the contact side of the contact elements arranged above one another.

Further, the casings of the higher situated contact elements formed according to the invention, i.e., the contact elements which, viewed from the printed circuit board, are situated above a contact element arranged adjacent to the plane of the board, automatically ensure the desired mutual alignment of the contact element during assembly.

Although the two casings can be electrically and mechanically interconnected by means of electrically conducting adhesive or soldering material, in an advantageous embodiment of the invention, the side-pieces are made resilient in the transverse direction, with a pre-tensioning of the side-pieces towards each other. This means that during assembly the above-mentioned first part of the side-pieces of a casing situated higher up engages in a mechanically clamping manner on the cylindrical part of a casing situated lower down, and tolerance difference in the dimensions of the side-pieces and the connection ends thereof, in particular as regards the length viewed in the direction transverse to the plane of the printed circuit board, can easily be absorbed for electrically connecting the connection ends of the casings to the corresponding connection patches of the circuit on the board.

The connection ends for mounting on a printed circuit board can be made either for the known pin/hole soldering mounting or for surface mounting by soldering or electrically conducting adhering on the corresponding connection patches on a surface of a printed circuit board.

Mounting on a printed circuit board for surface mounting techniques, which at one side has circuit tracks and connection patches for mounting the desired electrical and electronic components and at the other side has a layer of electrically conducting material to be connected to the signal earth of a circuit, means that as regards the shielding effect of a casing it is less important whether the side-pieces contact each other or are separate from each other. The above-mentioned conducting layer of the printed circuit board to be connected to the signal earth also in the latter case provides a sufficently effective shield against electromagnetic radiation from and to the electrical conductor connected to the inner contact part and surrounded by the casing.

The use of surface mounting technology also ensures that high frequency (HF) electromagnetic radiation from the ends, projecting from under a printed circuit board, of the electrical conductor connected to the inner contact part is prevented in the case of pin/hole soldering mounting. In particular, with the use of so-called mother/daughter board configurations, such an HF radiation can cause undesirable electromagnetic interferences.

In the preferred embodiment of the connector module according to the invention, the connector ends of a casing are in the form of projections for surface mounting, situated near the corner points of rectangular parts of the side-pieces, with a flat end formed at right angles to the side-pieces for mounting on a corresponding connection patch. These projections also serve to provide stable support for the casings on the printed circuit board.

The connection end of the conductor connected to the inner contact part is also preferably provided with a flat end for electrical connection to a connection patch of the board. If a visual inspection of the position of the inner conductor relative to the corresponding connection patch is desired prior to the electrical connection thereof, it is advantageous to use a further embodiment of the invention, in which the casing is provided with a movable cover at the end facing away from the contact side of the contact element.

The corresponding contact element cab now be positioned with open cover on the printed circuit board, following which the position of the conductor relative to the corresponding connection patch can be checked and corrected if necessary. The cover can then be closed. If the cover is also provided with connection ends for surface-mounting on the printed circuit board, no separate locking means for locking the cover on the casing need be provided. By providing the cover with an elongated lip and the casing with a groove for receiving this lip, the cover can be easily, slideably mounted on the casing.

The casing is preferably provided with electrically insulating material, at least in a part thereof bounded by the side-pieces for supporting and positioning the electrical conductor connected to the inner contact part. This electrical conductor can itself be provided with an electrically insulating sheath if necessary.

Two or more contact elements with casings according to the invention can be assembled as a separate unit for incorporation in a housing, and the unit and the housing can be provided with means for interlocking thereof if desired. A plurality of these units can be adjacently arranged in order to form a coaxial connector having a plurality of contact elements arranged in rows and columns.

In a preferred embodiment the locking means are composed of at least one groove formed in the housing and at least one corresponding lobe projecting from the casing, in such a manner that when the unit and the housing are mounted the at least one lobe engages in the at least one groove, and the one or more casings project outside beyond the housing for connection to a printed circuit board.

Instead of providing the contact elements and the housing with corresponding locking means, the housing and the contact elements can also simply be fixed separately to the board if desired. The contact elements can in this case be fixed by soldering or adhering their connection ends to the corresponding connection patches, while the housing can be fixed to the printed circuit board by means of the fixing means described in European Patent Application 0,390,295, if necessary designed for surface mounting.

The invention also relates to a housing and coaxial contact elements such as those described above. These contact elements can be provided with an inner contact part in the form of either a socket contact or a plug contact.

The term "printed circuit board" is understood to mean in general any board or substrate with electrically conducting tracks or paths and connection patches, thus for example also a substrate of a liquid crystal display and the like.

The invention is explained in greater detail below by means of a number of exemplary of embodiments with reference to the drawings, in which:

DETAILED DESCRIPTION OF THE EMBODIMENT

Figure 1:
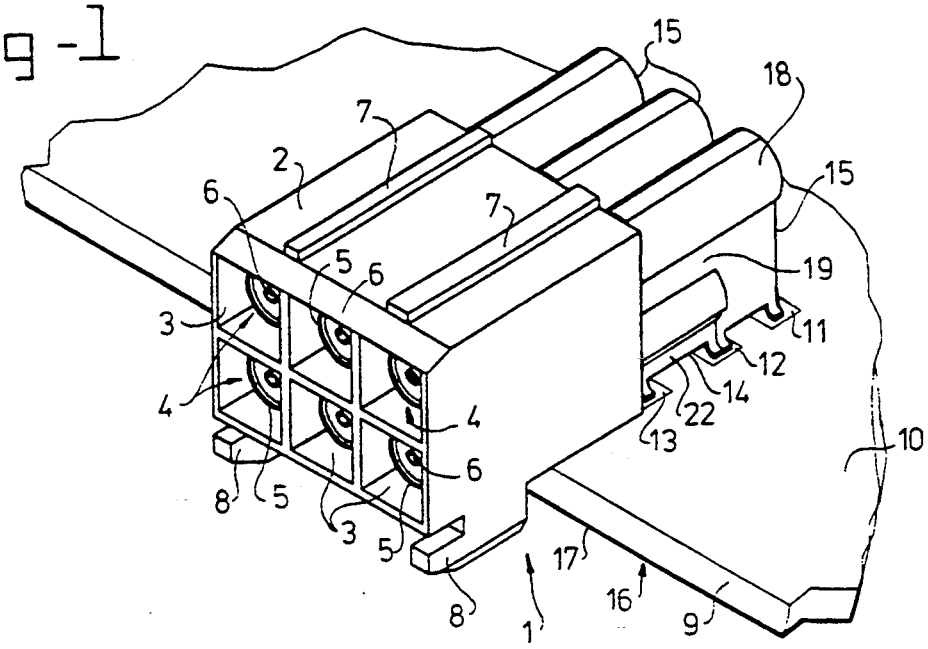
FIG. 1 shows schematically in perspective a coaxial connector module according to the invention, mounted on a surface of a printed circuit board.

In FIG. 1 a coaxial connector module according to the invention is shown by reference number 1, and comprises a housing 2 of plastic, which in the embodiment shown has two rows each with three channels 3 arranged in columns and having therein a coaxial contact element 4. Each coaxial contact element 4 comprises a circular cylindrical outer contact part 5 surrounding a socket-type inner contact 5 part 6, both of electrically conducting material.

Figure 5:
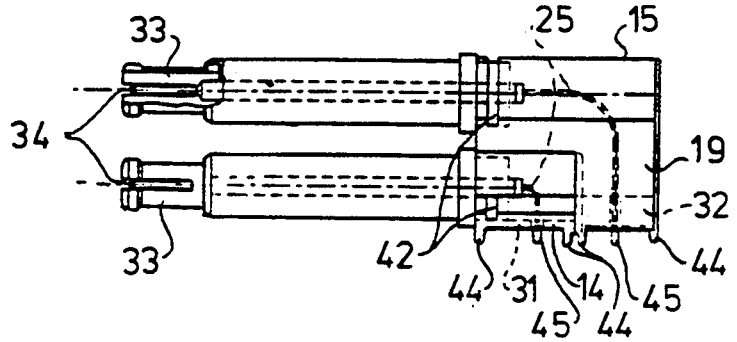
FIG. 5 shows schematically a longitudinal view of two coaxial contact elements according to the invention mounted one on top of each other, and provided with a contact side in the form of male contacts.

The housing 2 is provided with lobes 7 for engaging in corresponding grooves of a further connector to be contacted with the connector 1, for example the coaxial connector module 2 shown on FIG. 1 of European Patent Application 91203142.4, which is now a prior publication. The hook-shaped projections 8 of the housing 2 serve to lock the connector 1 to the further connector. It will be clear that the lobes 7 and hooks 8 are optional. The connector 1 can also be provided with more or fewer coaxial contact elements 4, whose contact side can also be in the form of a plug contact, as shown in FIG. 5.

For shielding purposes and right angle connection to a printed circuit board 9, which is provided at one side 10 with connection patches 11, 12, 13 for surface mounting, from which one or more circuit tracks (not shown) can extend on the surface 10, the coaxial contact elements 4 are provided with casings 14, 15 of electrically conducting sheet material according to the invention. The printed circuit board 9 is preferably provided with an electrically conducting layer 17 at its other side 16, for connection to the signal earth of the electrical circuit formed by the electrical and electronic components (not shown) to be mounted or already mounted on the board 9 at the side 10.

Figure 2:
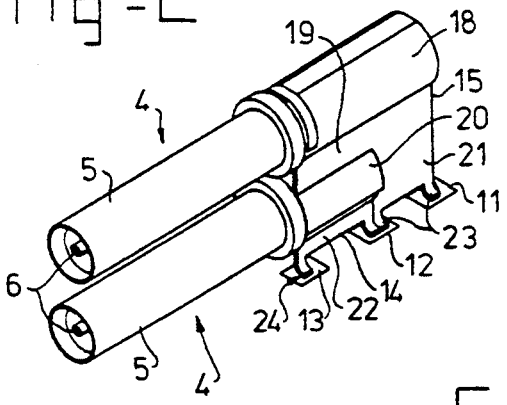
FIG. 2 shows schematically in perspective two coaxial contact elements according to the invention mounted one on top of the other.

FIG. 2 shows an assembly or unit of two coaxial contact elements 4 of the type shown in FIG. 1 situated in a column one above the other. For the sake of clarity, the connection patches 11, 12 and 13 are also shown.

As can be seen clearly from FIG. 2, the casing 15 of the coaxial contact element situated higher up comprises a cylindrical part 18, which extends in line with the outer contact part 5, and at the connection side facing the connection patches 11, 12, 13 is provided with side-pieces or flanges 19, of which a first part 20 is made circular cylindrical and engages on the corresponding cylindrical part 18 of the casing 14 of the coaxial contact element situated below, while the second part of the side-pieces 19 extending beyond the lower situated coaxial contact element extends in the form of flat sheets 21 until close to the connection patches 11, 12. The side-pieces or flanges 22 of the casing 14 of the lower situated coaxial contact element are simply composed of rectangular sheet parts extending in the direction of the connection 10 patches 12 and 13.

For right angle surface mounting connection to the respective connection patches 11, 12, 13 the flat sheet parts of the side-pieces 19, 22 are provided near their corner points with projections 23, which are flanged outwards and extend with their flat surface 24 transverse to the side-pieces 19, 22.

Figure 3:
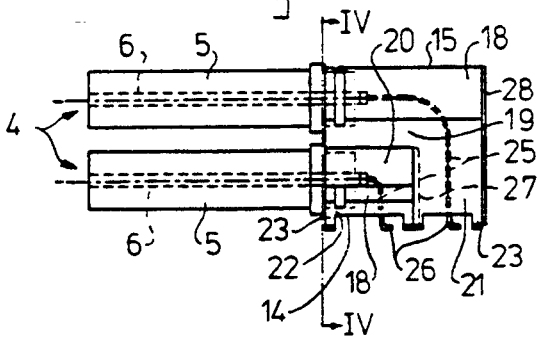
FIG. 3 shows schematically in longitudinal view the assembly of coaxial contact elements shown in FIG. 2, provided with a contact side in the form of female contacts.

FIG. 3 shows a longitudinal view of the assembly of coaxial contact elements 4 shown in FIG. 2, in which the inner contact parts 6 on the contact side and the electrical conductors 25 connected thereto, with connection ends 26 for surface mounting which are surrounded and electrically insulated by the casings 14, 15, are indicated by dashed lines. At the end facing away from the contact side the casings 14, 15 are closed by means of a cover 27, 28.

Figure 4:
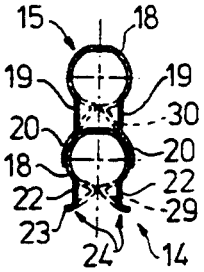
FIG. 4 shows a partial schematic view along the line IV—IV in FIG. 3.

FIG. 4 shows a section along the line IV—IV FIG. 3, the inner contact part 6 and the electrical conductor 25 being omitted for the sake of clarity.

It can be seen from this sectional view that the cylindrical part 18 of the side-pieces 19 of the top casing 15 connects to the cylindrical part 20 of the lower situated casing 14. The lower casing 14 consequently acts as a shield for the electrical conductor 25 of the contact element situated above it. When a printed circuit board 9 provided with a protective layer 17 is used, as shown in FIG. 1, this layer 17 acts as a shield for the electrical conductor 25 of the casing 14 situated directly above the board 9.

If desired, and in particular when a printed circuit board 9 without protective layer 17 is used, for example in the case of pin hole soldering mounting, the casing 14 can also be formed in such a manner that the side-pieces 22 touch each other, as shown by dashed lines 29. Of course, the side-pieces 19 of the casing 15 can also be designed in this way, as indicated by dashed lines 30. The further embodiment shown by dashed lines 29, 30 also has the advantage that an optimum impedance match can be achieved, because the symmetrical shape of the outer and inner contact part 5, 6 is continued as much as possible at the connection side by the corresponding casings 14, 15 and the electrical conductors 25.

FIG. 5 shows a similar view to that of FIG. 3, but the contact sides of the coaxial contact elements are in the form of male contacts, with an outer contact part 33 and a pin-shaped inner contact part 34, both of electrically conducting material.

Plastic support elements for the conductors 25, disposed between the side-pieces 19, 22, are indicated by reference numbers 31 and 32. Instead of plastic, the elements 31 and 32 can, of course, be made of any other suitable insulation material, while the conductors 25 themselves can be provided with an electrically insulating sheath. For locking the contact elements on the housing 2 of the casings 14, 15 are provided with a lobe 42.

In this embodiment of the invention the connection ends of the casings 14, 15 and of the conductors 25 are by way of illustration in the form of soldering pins 44, 45 for pin/hole soldering mounting on a printed circuit board. Of course, the soldering ends in question can also be designed for surface mounting as shown in the embodiment according to FIGS. 1–3.

Figure 6:
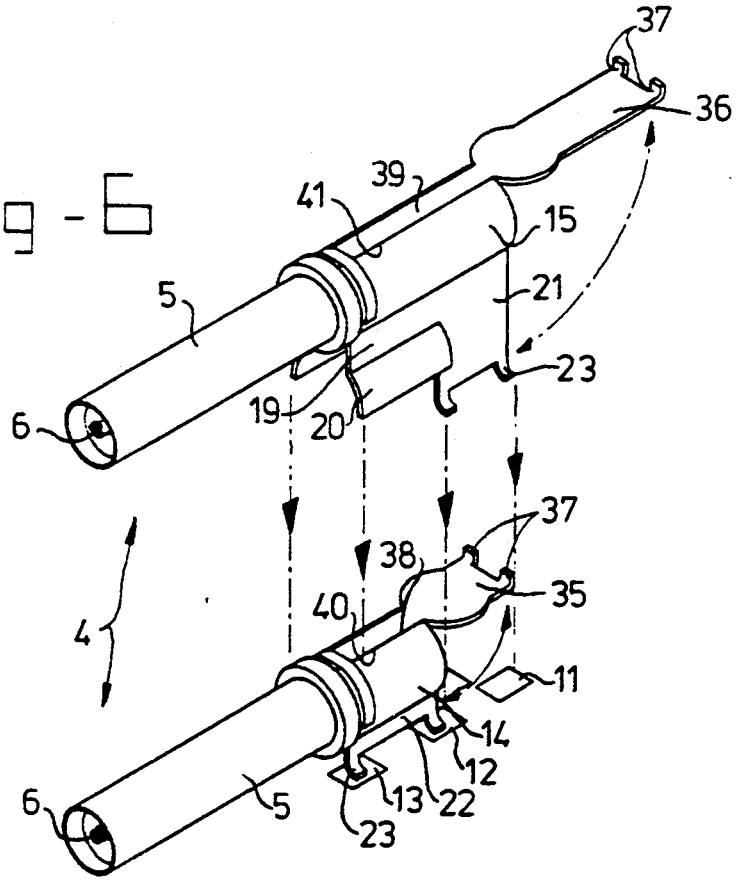
FIG. 6 shows schematically in perspective coaxial contact elements according to a further embodiment of the invention.

FIG. 6 shows a further embodiment of the invention, in which the covers 27, 28 of the sheath ~ 14, 15 are in the form of swingable covers 35, 36, each provided with connection ends 37 far surface mounting on connection patch 12, 14. In the embodiment shown the covers 35, 36 are provided with a lip 38, 39, which is accommodated in a corresponding groove 40, 41 of the casing 14, 15.

The advantage of using such covers 35, 36 is that the contacting of the conductor 25 with a connection patch of the printed circuit board 9 prior to electrical connection, for example by soldering, can be inspected.

The side-pieces 19, 22 are preferably pre-tensioned to spring towards each other, in such a manner that the cylindrical part 20 of side-pieces 19 engages in a clamping manner on the cylindrical part 18 of the contact element situated lower down, while during the positioning of the casings on the printed circuit board 9 as a result of the spring action a firm contacting of the projections 23 on the respective connection patches is outlined, and compensation can also take for tolerance differences in the dimensions of the side-pieces 19, in particular the dimensions at right angles to the board 9. All this is such that a firm contact between the projections or connection ends 23 and the corresponding connection patches is guaranteed. The connection ends 23 can be connected with their faces 24 in the usual manner by a suitable surface mounting technique to the corresponding connection patches 11, 12, 13, as can the connection end 26 of the conductors 25.

In a practical embodiment the casings are formed by punching and suitable modulation from a sheet of nickel-plated steel 0.2 mm thick. The casings can be electrically connected to the respective outer contact parts by spot welding, by riveted connections, folded joints etc.

The invention is of course, not restricted to the embodiment shown of two contact elements mounted one above the other. If desired, three or more contact elements can be electrically connected to a printed circuit board by the method according to the invention.

We claim as our invention:

1. A coaxial connector module, comprising:

a housing of electrically insulating material having at least two electrical contract elements, each said electrical contact element having a contact side having a coaxial inner and outer contact part for contacting a further connector and a right angle connection side for mounting on a printed circuit board, the right angle connection side having an electrical conductor which is connected to the inner contact part and has a connection end for mounting on the printed circuit board, said electrical conductor is surrounded in an electrically insulating manner by a shielding casing of electrically conducting sheet material which is electrically connected to the outer contact part, said shielding casing having an essentially circular cylindrical shape which towards the connection end of said electrical conductor merges into two adjacent side-pieces, said side-pieces having at least one connection end for mounting on the printer circuit board, and the at least two electrical contact elements are disposed above one another viewed from said right angle connection side, wherein a first part of the side-pieces of the casing of a higher situated contact element bounds and engages a circular cylindrical cross-section of an adjacent shielding casing of a lower situated contact element, while a second part of said side-pieces of said higher situated contact element extends beyond the lower situated casing and having at least one connection end.

2. A coaxial connector module according to claim 1, wherein said side-pieces are made resilient in their transverse direction.

3. A coaxial connector module according to claim 1, wherein the connection ends of a casing are projections formed near corner points of the side-pieces for surface mounting, with a flat end formed at right angles to said side-pieces.

4. A coaxial connector module according to claim 3, wherein said casing is provided with a movable cover at an end facing away from the contact side of the contact element.

5. A coaxial connector module according to claim 4, wherein said cover is provided with an elongated lip and the casing having a groove for receiving said lip when mounting the cover to the casing.

6. A coaxial connector module according to claim 4, wherein said cover is provided with at least one connection and for surface mounting.

7. A coaxial connector module according to claim 1, wherein two or more contact elements disposed above one another form a separate unit for accommodation in the housing, which unit and housing are provided with means for interlocking thereof.

8. A coaxial connector module according to claim 7, wherein said locking means comprise at least one groove formed in the housing and at least one corresponding lobe projecting from a casing, in such a manner that when the unit and the housing are mounted said at least one lobe engages in said at least one groove and said one or more casings project outside beyond the housing for connection to a printed circuit board.

9. A coaxial connector module according to claim 7 comprising a plurality of adjacently arranged units.

10. A coaxial connector module, comprising:

a housing of electrically insulating material having at least two electrical contact elements, each said electrical contact element having a contact side and a right angle connection side, the right angle connection side having an electrical conductor, said electrical conductor is surrounded in an electrically insulating manner by a shielding casing of electrically conducting sheet material, and the at least two electrical contact elements are disposed above one another viewed from said right angle connection side, wherein a part of the casing of a higher situated contact element bounds and engages a cross-section of an adjacent shielding casing of a lower situated contact element situated.

11. A coaxial connector module according to claim 10, wherein said electrical conductor has a connection end, said shielding casing has an essentially circular cylindrical shape which towards the connection end of said electrical conductor merges into two adjacent side-pieces, said side-pieces having at least one connection end.

12. A coaxial connector module according to claim 11, wherein a first part of the side-pieces of the casing of the higher situated contact element bounds and engages a circular cylindrical cross-section of the adjacent shielding casing of the lower situated contact element, while a second part of said side-pieces of said higher situated contact element extends beyond the lower situated casing and has at least one connection end.

* * * * *